US005697828A

United States Patent [19]

Smathers et al.

[11] Patent Number: 5,697,828

[45] Date of Patent: Dec. 16, 1997

[54] TOY COIN BANK WITH AUDIO SIGNAL

[75] Inventors: Robert Smathers, Los Angeles; Steven Vetter, Santa Monica; Sheldon Goldberg, Encino; Sang Kwak, LaHabra; Jordan Kort, Encino, all of Calif.

[73] Assignee: Imperial Toy Corporation, Los Angeles, Calif.

[21] Appl. No.: 617,294

[22] Filed: Mar. 18, 1996

[51] Int. Cl.[6] ..... A45C 1/12

[52] U.S. Cl. ..... 446/11; 473/480

[58] Field of Search ..... 446/8–12; 232/4 R; 273/374, 317, 340, 377, 382, 381

[56] References Cited

U.S. PATENT DOCUMENTS 385,225 6/1888 Bailey .
3,581,430 6/1971 Glass et al. .
3,667,136 6/1972 Goodkind et al. .
4,297,807 11/1981 Buettner .
4,496,149 1/1985 Schwartzberg .
4,759,551 7/1988 Crompton ..... 273/377 X
5,064,195 11/1991 McMahan et al. ..... 273/374
5,465,909 11/1995 Roth .

*Primary Examiner*—Mickey Yu
*Attorney, Agent, or Firm*—Blakely, Sokoloff, Taylor & Zafman LLP

[57] ABSTRACT

A toy coin bank that directs a user to launch a coin at a target portion is disclosed. The toy coin bank includes an adjustable launching platform or tray to permit the user to decide the appropriate launch position. The toy bank also includes an audio signal to alert the user of his or her success in hitting the target.

8 Claims, 7 Drawing Sheets

TOY COIN BANK WITH AUDIO SIGNAL

FIELD OF THE INVENTION

The invention relates to my articles and more particularly to toy coin banks.

BACKGROUND OF THE INVENTION

Toy coin banks are generally known in the art. To encourage the saving of coins, many of these banks utilize interesting ways of launching or propelling a coin into a coin collection area or depository. Some collection areas or depositories contain a target portion wherein the coin contacts or passes through the target portion in its passage to the depository. U.S. Pat. No. 385,225 describes a toy bank that represents the kicking motion of a football player kicking a football. A coin is placed in a football-receptacle, the player's spring-loaded leg is cocked and released, and the football-receptacle with the coin inside is projected at a storage bank.

U.S. Pat. No. 3,581,430 discloses a toy bank that is a shooting gallery wherein coins are placed in a rifle or cannon-like structure and fired at various targets. The successful firing of a coin at a target is rewarded by a return of the coin permitting a subsequent firing. The target area includes slots for a coin to pass through and a return ramp to return the successfully launched coins to the rifle or cannon-like structure. The patent contemplates that a bell or bell-like structure may he placed behind a target opening wherein a coin that successfully goes through the target opening will contact the bell before being directed back to the firing area. Finally, coins that miss the designated target will he directly fed into the security portion of the bank.

Toy coin banks that utilize various sound means are also known in the art. As described above, U.S. Pat. No. 3,581,430 uses a bell to alert the user that a particular target has been struck. U.S. Pat. No. 3,667,136 discloses a coin bank receptacle that reproduces certain audible signals when a particular action has been completed. The device operates, for example, by alerting the user of the denomination of coin that is inserted. There is no launching or propelling of the coin. The audio signal includes a multi groove disk or record on a turntable, wherein various sayings recorded in individual grooves are played corresponding to the particular denomination of coin that is placed in the bank.

U.S. Pat. No. 5,465,909 discloses a talking contribution box for the receipt of charitable contributions. Upon placement of a contribution in the contribution box, a mechanism is actuated that provides a short message in response to the contribution. The audio device is a conventional 4-channel programmable voice driver. Each of the voice channels may be pre-programmed with a response for contribution.

What is needed is a toy bank that captures a child's attention and encourages savings by launching a coin, thereby introducing the variable of the possibility of missing a target portion, and rewarding a child with an audio signal when the target portion is contacted or passed through, and alerting or encouraging a child when the target is missed.

SUMMARY OF THE INVENTION

The invention relates to a toy coin bank that directs a user to launch coins at a target portion and into a coin collection area. If a coin contacts or passes through the target portion, an audio signal alerts the user of his or her success. An audio signal may also alert the user when the target portion is missed. The toy coin bank provides an adjustable coin launching platform or tray to introduce the variable of the possibility of missing the target portion with the launch.

The bank includes a base that contains a fast area, a second area, and a coin collection area. A coin launching means is coupled to the first area of the base. The coin launching means includes means for receiving and launching a coin. A target area including a target portion is coupled to the second area of the base. Coins are received in the coin launching means and hunched toward the target area. A signal means is coupled to the target area to provide an audio signal when a launched coin hits or passes through the target portion. The toy coin bank further has a transparent housing coupled to the base and encapsulating the target area. In a preferred embodiment, the target portion is a basketball hoop through which a coin can pass. In this embodiment, when a coin passes through the basketball hoop, the coin activates the signal means. The signal means alerts the user that the coin passed through the hoop by announcing a familiar basketball statement, such as "NICE SHOT". This embodiment further contemplates that a separate signal means, located in the coin collection area, will also alert the user when the target is missed. Statements such as "TRY AGAIN", "NO BASKET", "NICE TRY", and the like, are contemplated.

DETAILED DESCRIPTION OF THE INVENTION

The invention relates to a toy coin bank wherein a coin is inserted into an adjustable tray, the tray is adjusted to a position the user believes is appropriate, a trigger is pulled and then released to launch the coin toward a target area with a target portion. If the coin hits the designated target portion, a signal means coupled to the target area provides an audio signal alerting the user that the coin successfully hit the target portion.

Figure 1:
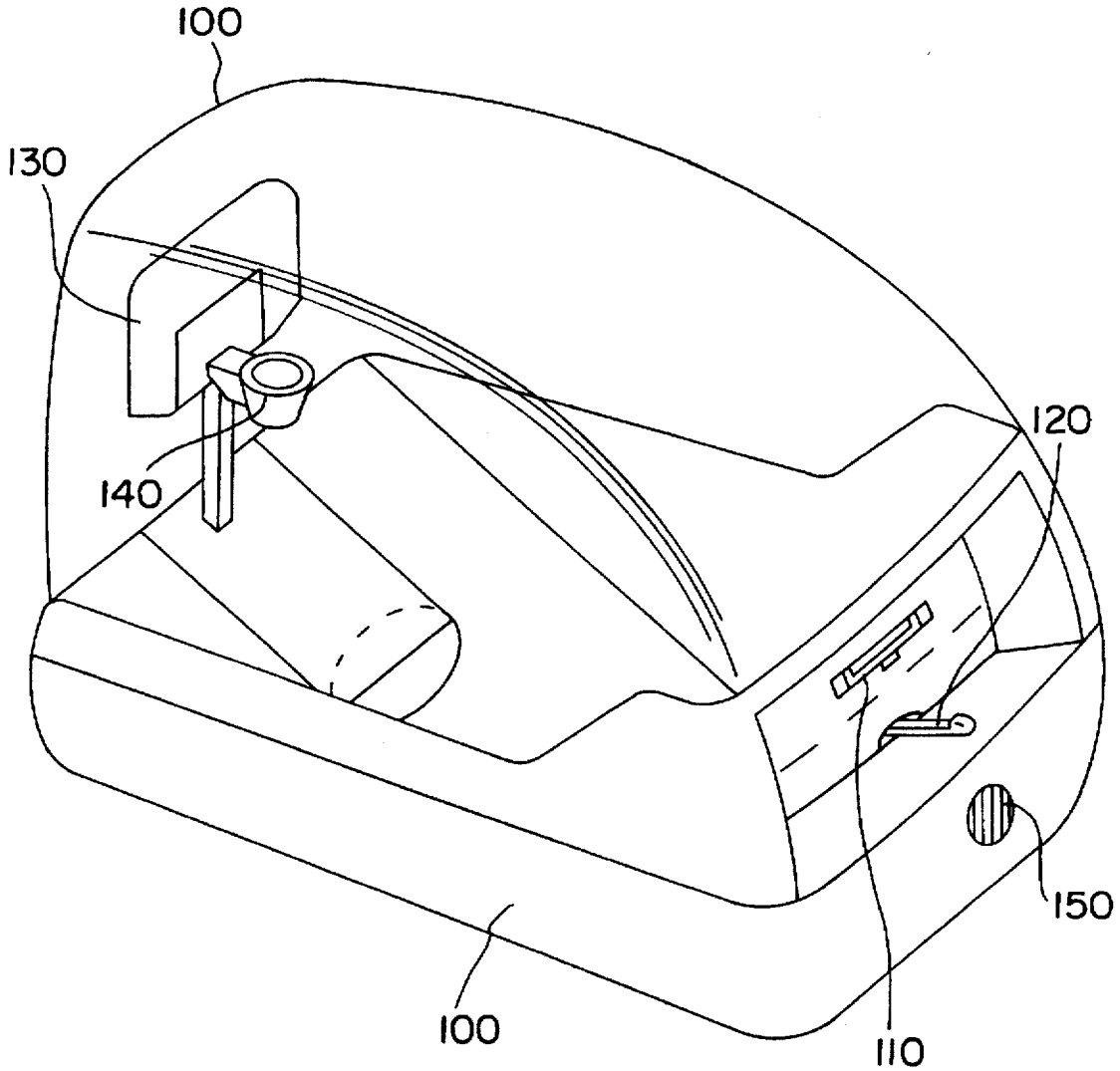
FIG. 1 is a perspective view of a preferred embodiment of the toy bank of the invention.

FIG. 1 illustrates a preferred embodiment of the invention. FIG. 1 is a perspective view of a toy coin bank of the invention wherein the target area simulates a basketball court with a target portion that is a basketball hoop or basket. The toy bank of FIG. 1 includes a base 100, a target area portion 130 that is a basketball court including a key, backboard and hoop 140, and a coin bunching means that includes an adjustable tray 110 for receiving and launching a coin and a trigger 120 for launching the coin at the target area. If a coin passes through the target portion 140 of the target area 130, the coin will activate an audio signal with an audio chip that will announce, through speaker 150, an appropriate pre-recorded congratulatory phrase, e.g., "NICE SHOT".

Figure 2:
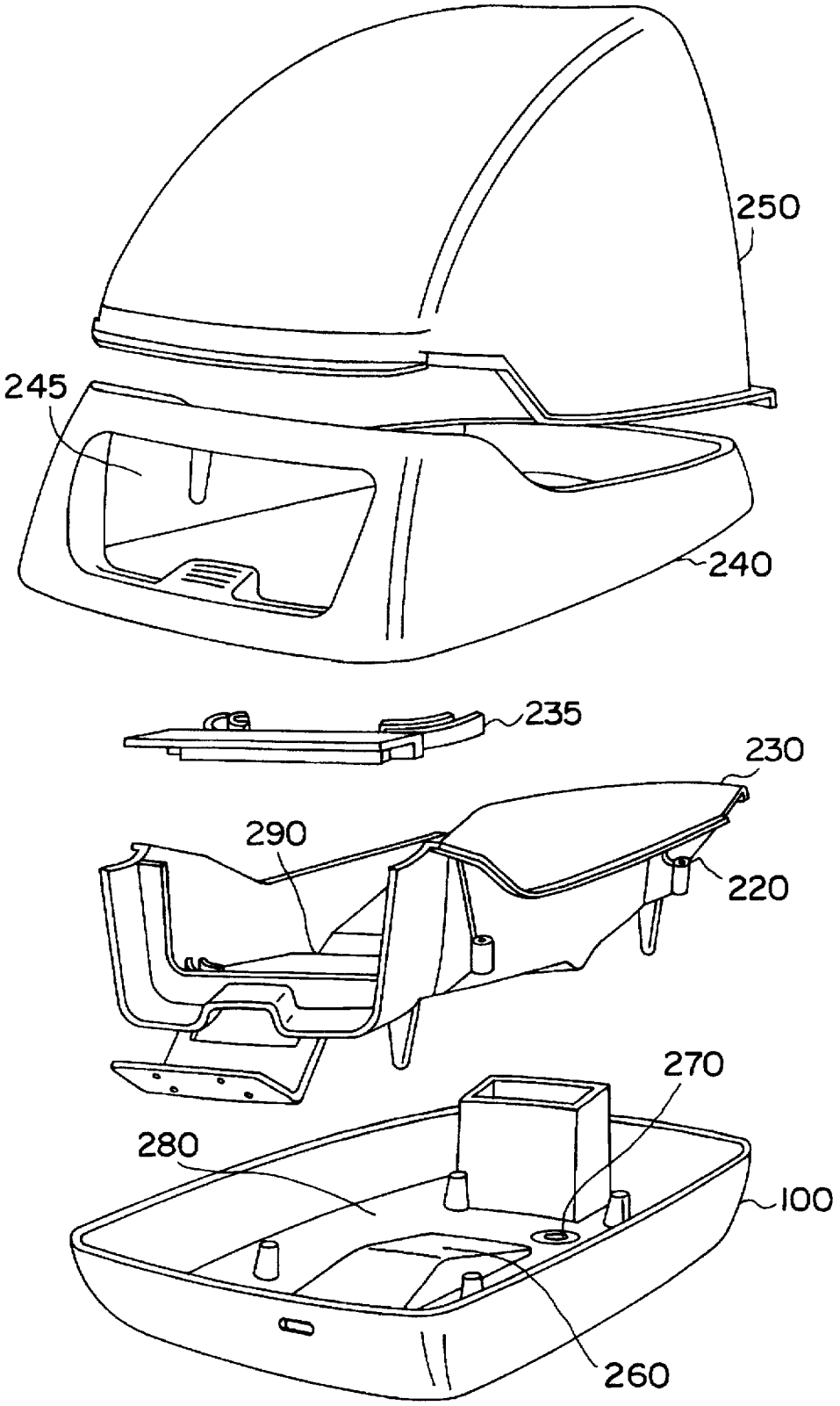
FIG. 2 is an exploded perspective view of an embodiment of the toy bank of the invention, specifically illustrating the base, collecting portion, a portion of the coin launching means and transparent enclosure.

FIG. 2 illustrates an exploded perspective view of the housing of a preferred embodiment of the invention. FIG. 2 shows a base 100, a lower housing 220, a lower shelf 235, an upper housing 240, and a transparent enclosure 250. The lower housing 220 contains a ramp 230. The ramp 230 serves to support the movement of coins from the target area to the coin collection area 280 in the base 100 of the invention. When a coin is launched toward the target area, whether or not the coin contacts or passes through the target portion, the coin slides down the ramp 230, and falls through a slot 290 at the base of the lower housing 220 onto a pointed platform 260 that directs the coin into the coin collection area 280 and away from the slot 290 in the lower housing 220. A removable plug 270 is provided to remove coins from the coin collection area 280.

The lower shelf 235 lies at the bottom of the lower housing 220. The upper housing 240 sits atop the lower housing 220, creating an opening above the lower shelf 235 and beneath the base of the upper housing 240. The trigger of the coin launching means (not shown) extends through the opening. The upper housing also has an opening 245 through which extends the adjustable tray (not shown) for receiving and launching coins toward the target area. The transparent plastic cover 250 serves to encapsulate the target area of the apparatus to keep received and launched coins inside the apparatus.

Figure 3:
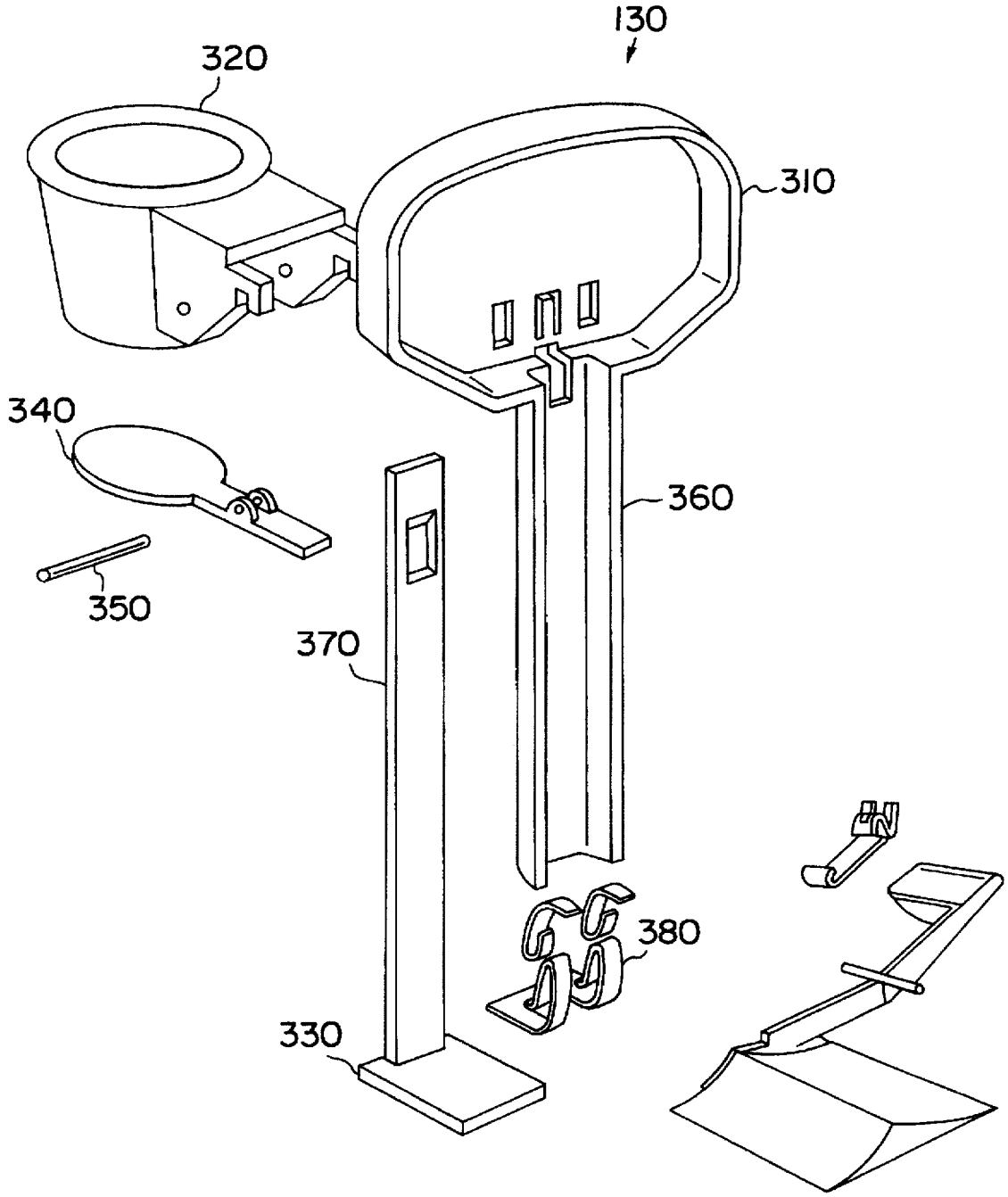
FIG. 3 is an exploded perspective view of the preferred embodiment of a target portion of the invention.

FIG. 3 illustrates the target area 130 of the invention. FIG. 3 shows an exploded view of the target area 130 of the invention. FIG. 3 shows a target area that is a basketball court including a basketball hoop or basket 320 coupled to a basketball backboard 310, the unit elevated by column housing 360. A coin is launched in an attempt to make the coin pass through the basketball hoop or basket 320. The hoop or basket 320 is the target portion of the invention through which a coin must pass to activate the audio signal. Basket lever arm 340 is pivotally coupled to column 370 by use of coupling pin 350. A portion of basket lever arm 340 lies directly beneath the basketball hoop 320. Column 370 lies adjacent to and inside column housing 360 whereby column 370 is free to slide vertically within the column housing 360. Thus, displacement of the basket lever arm 340 will displace column 370 and cause it to rise vertically within column housing 360. At the base of the column 370 is a column contact platform 330 that contains a conductive material 380 to engage a portion of an electrical circuit to form a contact provide an audio signal.

When a coin passes through the target portion 320, the coin contacts and displaces the basket lever arm 340. The downward force on basket lever arm 340 pivots the lever arm 340. The pivoting motion of the basket lever arm 340 causes the column 370 to slide vertically upward toward the backboard 310 in the column housing 360. The vertical movement of the column 370 translates into a similar vertical movement for the column contact platform 330. When the basket lever arm 340 pivots and moves the column 370 vertically, the column contact platform 330 also moves vertically toward the basketball backboard 310. The vertical movement of the column contact platform 330 causes the conductive material 380 to make a contact and to close the circuit (not shown) that triggers an audio signal alerting the user that a coin has hit or passed through the target portion 320. After the audio signal is emitted, the column slides downward by its own accord to replace the basket lever arm 340 to its original position with a portion of the basket lever arm 340 lying directly below the basketball hoop 320.

Figure 4:
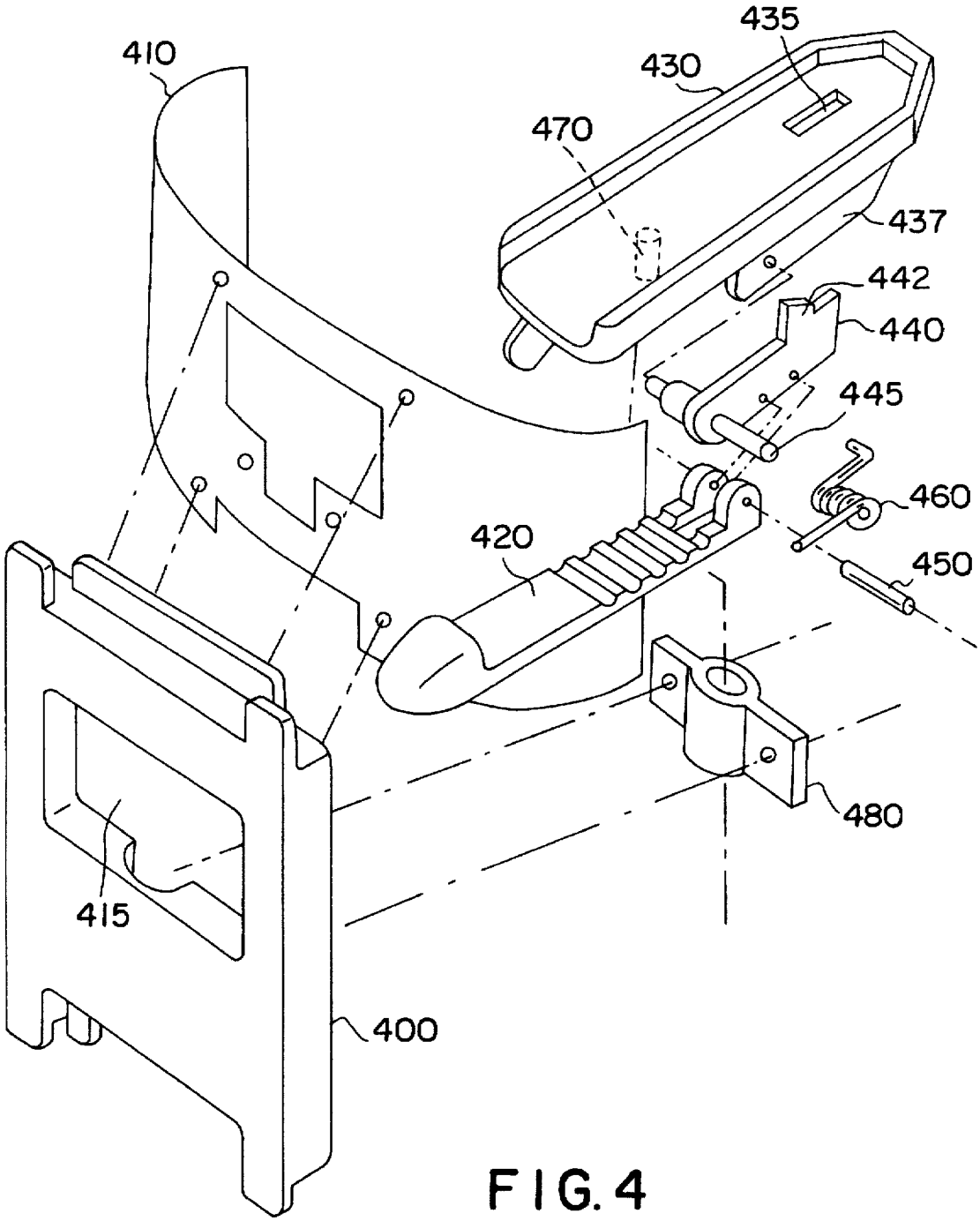
FIG. 4 is an exploded perspective view of the coin launching means of the invention.

FIG. 4 illustrates a preferred embodiment of the coin launching means of the invention. The coin launching means includes a carriage harness 400 and backing plate 410 that form an opening through which trigger 420 extends. The rear end of trigger 420 is pivotally coupled to a lever arm 440. An adjustable tray 430 for receiving and launching a coin is pivotally coupled at it's base through base member 437 to lever arm 440 through coupling post 445. Lever arm 440 is springloaded by the use of a torsion spring 460 coupled to coupling post 445. When the trigger is pulled toward the opening, the torsion spring 460 is loaded. When the trigger 420 is released, the tension on torsion spring 460 is released which causes lever arm 440 to pivot forcefully and strike a coin in the adjustable tray 430 with a striking portion 442 of the lever arm 440.

The adjustable tray has a slot 435 through which the striking portion 442 of the lever arm 440 is inserted. The way also includes a center pin 470 extending from the tray base and into a steering socket 480 that is mounted on the carriage harness. The center pin 470-carriage harness 48 feature allows lateral movement of the way 430 by laterally moving the trigger 420. In this manner, a user can vary the location of the way 430 before a coin is launched.

Figure 5:
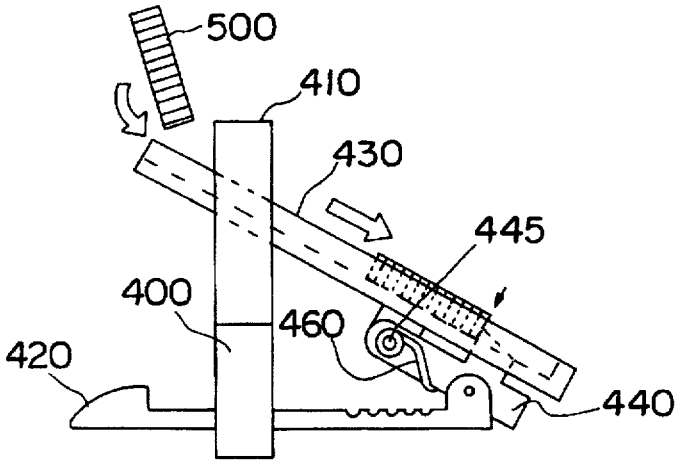
FIGS. 5–7 are planar side views of a portion of the coin launching means illustrating the receipt and launching of a coin.
Figure 6:
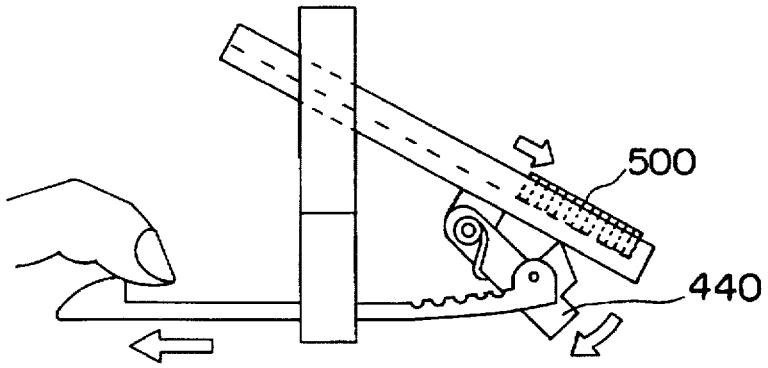
Figure 7:
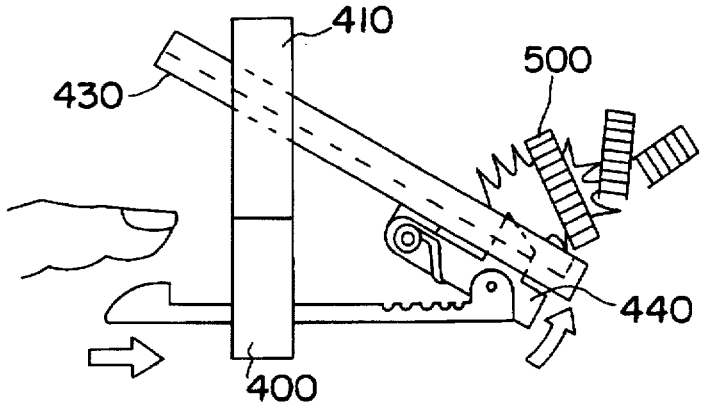

The operation of the coin launching means is best exemplified in FIGS. 5–7. FIGS. 5–7 show a planar side view of a portion of the coin launching means including the carriage harness 400 and the upper housing 410, the trigger 420 pivotally coupled to the lever arm 440, and a tray 430 sloping toward the trigger 420 and pivotally coupled to the lever arm 440 through the coupling post 445. FIGS. 5–7 also show a torsion spring coupled to the lever arm 440 through the coupling post 445. The application and release of tension on the torsion spring 460 will cause the striking portion of the lever arm 440 to strike and launch a coin.

In FIG. 5, a coin 500 is received in the coin launching means by placing a coin 500 on to the way 430. The way 430 is mounted at an angle such that the coin 500 slides down the tray and stops at the striking end of the lever arm 440. The tray 430 is adjusted laterally by sliding the trigger 420 in a lateral position. Next, as shown in FIG. 6, the trigger 420 is pulled in a direction away from the carriage harness opening 400. The displacement of the trigger 420 displaces the striking portion of the lever arm 440 from the slot in the tray 430. When the striking portion of the lever arm 440 is displaced from the slot in the tray 430, the coin 500 slides further into the tray and above the slot in the tray 430 so as to completely cover the slot in the tray 430. The displacement of the trigger also loads the torsion spring 460. When the trigger is released, the torsion spring 460 is unloaded and the trigger springs back in a direction toward the carriage harness 400. The release of the spring tension of the torsion spring 460 causes the striking portion of the lever arm 440 to accelerate back into the slot of the tray 430 where it impacts the coin 500 and launches the coin 500 toward a target area as illustrated in FIG. 7.

Figure 8:
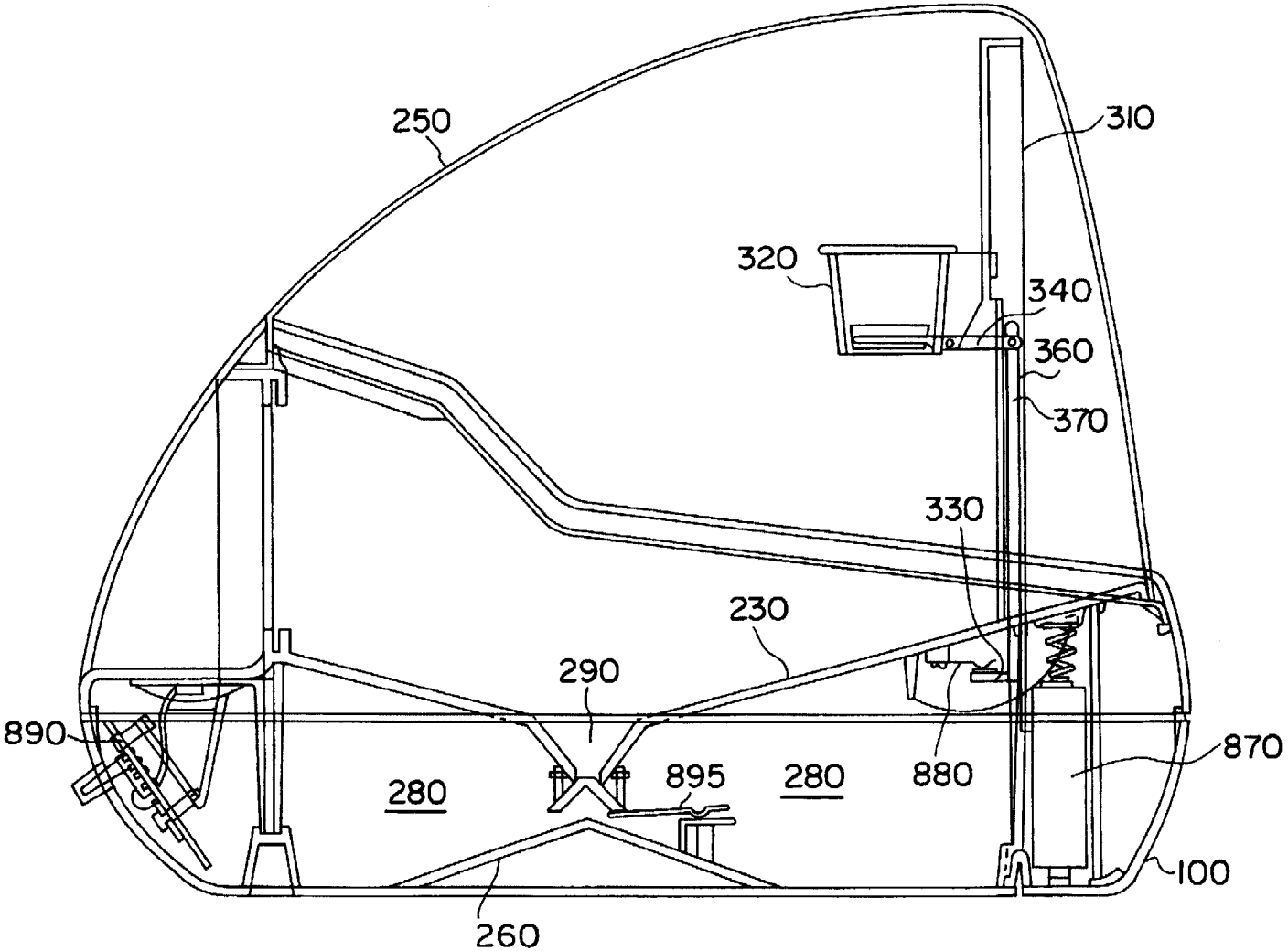
FIG. 8 is a planar side view of a preferred embodiment of the invention.

FIG. 8 illustrates a preferred embodiment of the signal means of the invention. FIG. 8 is a planar cross-sectional side view of a preferred embodiment of the invention. FIG. 8 shows the apparatus with a base 100 and a transparent enclosure 250. Inside the apparatus is a target area that is a basketball court including a backboard 310 and a basketball hoop or basket 320. The basketball backboard 310 is coupled to a column housing 360. At the base of the basket or hoop 320 is a basket lever arm 340 pivotally coupled to a column 370. Coupled to the base of the column 370 is a column contact platform 330. When a coin travels through the target portion that is a basketball hoop or basket 320, the coin displaces the basket lever arm 340. The displacement of the basket lever arm 340 displaces the column 370 in a direction toward the backboard 310. When the column 370 moves upwardly, the column contact platform also moves upward causing a conductive area on the column contact platform 330 to impact conductive arm 880 to form a first contact. The first contact formed by the union of the column contact platform 330 and the conductive arm 880 closes a first circuit that provides a pre-recorded audio signal stored in the circuit memory (e.g., an audio chip). The signal is powered by a power source that is a battery 870. The audio signal is sent to a speaker 890 at the front of the apparatus, and the audio signal is played through the speaker 890. The audio signal played is a familiar basketball statement, such as "NICE SHOT" or "ITS GOOD". The duration of the audio sequence is such that the audio signal signifying the successful basket is activated at least until the coin reaches the coin collection area.

The invention contemplates that the signal means will also alert a user when a projected coin misses the target portion. If a projected coin misses the target portion, the coin will travel down the ramp 230, fall through the slot 290 and come to rest in the coin collection area 280. To alert a user that the coin missed the target portion, a switch 895 is placed in the slot 290 to activate a signal means. When a coin passes through the slot 290, the coin actuates the switch 895 to close a second circuit to play a pre-recorded second audio signal stored in the circuit memory. This signal is also powered by the battery 870. The audio signal is sent to the speaker 890 at the front of the apparatus, and the audio signal is played through the speaker 890. The audio signal played is a familiar basketball statement, such as "NO BASKET" or "NO GOOD", or an encouraging phrase, such as "JUST MISSED", "NICE TRY" or "TRY AGAIN".

According to the invention, a launched coin that passes through the target portion will close the first circuit and the second circuit. The invention contemplates, however, that only one audio signal is played per launched coin, and that signal is dependent on whether or not the coin passed through the target portion. To select the appropriate signal corresponding to whether or not the coin passed through the target portion, the invention contemplates that the audio signal for a successful shot through the target portion overrides the audio signal for an unsuccessful shot. The audio signal for a successful shot overrides the audio signal for an unsuccessful shot by having an activated signal duration that is at least as long as the time it takes a projected coin to reach the coin collection area. In this manner, if a coin passes through the target portion, the successful audio signal will be activated (and the pre-recorded message played) until the coin travels along the ramp 230 and passes through the slot 290 into the coin collection area 280. If a coin misses the target portion, the successful signal will not be activated, but the unsuccessful signal will be activated once the coin passes through the slot 290 and actuates the switch 895 to close the second circuit The invention contemplates that the successful and unsuccessful statements can be stored on a single audio component, such as a known multi-channel programmable voice driver audio or sound chip. This technology is familiar to persons of ordinary skill in the art and is not described herein.

Figure 9:
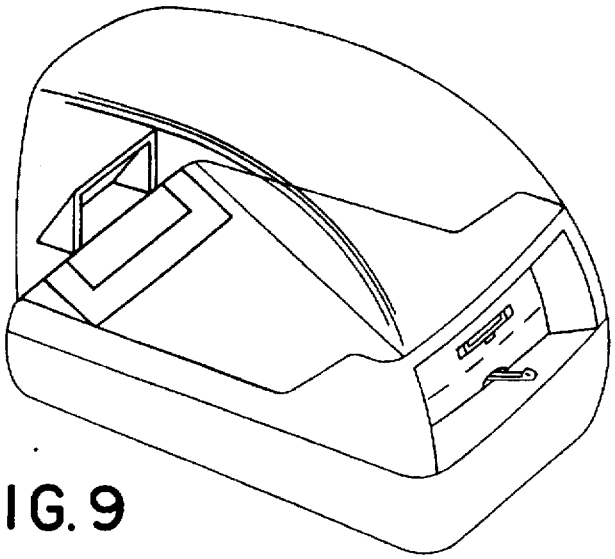
FIG. 9 is a perspective view of the invention wherein the target portion is a soccer goal.
Figure 10:
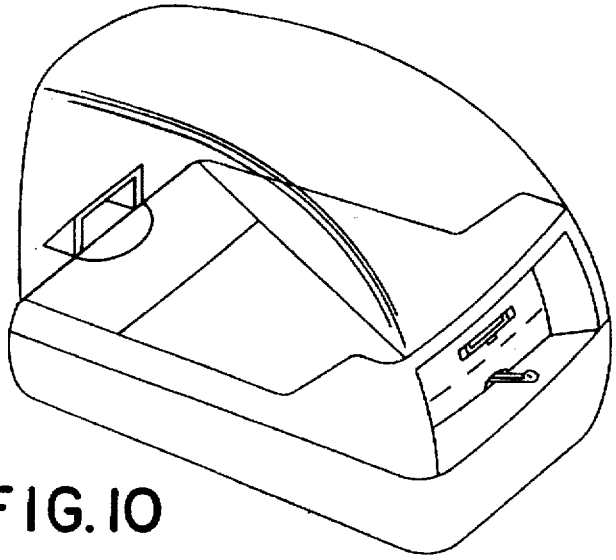
FIG. 10 is a perspective view of the invention wherein the target portion is a hockey goal.
Figure 11:
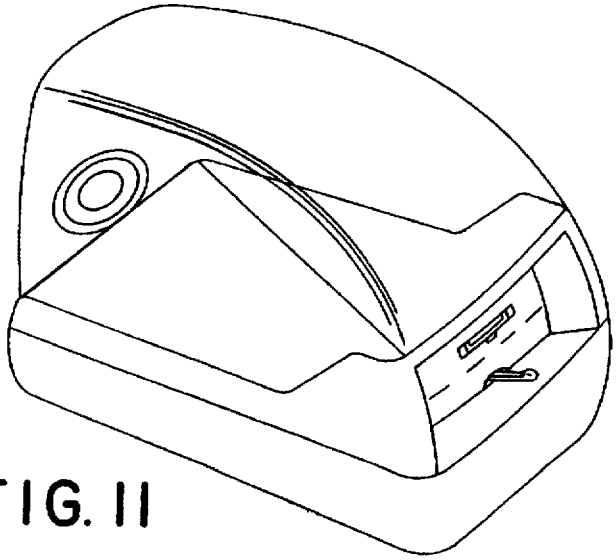
FIG. 11 is a perspective view of the invention wherein the target portion is a marked surface or target.

In the preceding detailed description, the invention is described with reference to specific exemplary embodiments thereof. It will, however, be evident that various modifications and changes thereto may be made thereto without departing from the broader spirit and scope of the invention as set forth in the claims. For example, the above embodiment describes a target area that is a basketball court. It is evident that the invention will work with a multitude of sports target areas, including hockey and soccer goals and bullseyes. The invention will also work with non-sports related target areas, for example, target areas that are jet planes. FIG. 9 shows a toy bank with a target area that is a soccer field and a target portion that is a soccer goal. FIG. 10 shows a toy bank with a target area that is a hockey ring wherein the target portion is a hockey goal. FIG. 10 shows a toy bank with a target portion that is a marked surface or target and wherein by simply changing the appearance of the target area, the target area can be a variety of different themes, i.e., bullseyes, skeet, jet fighter, etc. The specification and drawings are, accordingly, to be regarded in an illustrative rather than a restrictive sense.

We claim:

1. A toy bank comprising:

a base including a first area, and a second area, and a coin collection area between the first area and the second area;

an adjustable coin launching means coupled to the first area of the base, the coin launching means including means for receiving and launching a coin;

a target area including a target portion coupled to the second area of the base;

a first signal means coupled to the target area and activated when a launched coin hits the target portion;

a second signal means coupled to the coin collection area of the base and activated when a launched coin travels to the coin collection area; and a playing means coupled to the first signal means and the second signal means to provide a first electronic audio signal when the first signal means is activated and a second audio signal when the second signal means is activated, wherein the playing means provides one of the first electronic audio signal and the second electronic audio signal for a launched coin.

2. The toy bank of claim 1, further comprising a transparent housing couples to said base encapsulating said target area.

3. The toy bank of claim 1, wherein the target portion is a basketball hoop through which a coin can pass, and wherein the passage of a coin through the hoop activates the first signal means.

4. The toy bank of claim 1, wherein the target portion is a hockey goal through which a coin can pass, and wherein the passage of a coin through the goal activates the first signal means.

5. The toy bank of claim 1, wherein the target portion is a soccer goal through which a coin can pass, and wherein the passage of a coin through the goal activates the first signal means.

6. The toy bank of claim 1, wherein the target portion is a marked target surface.

7. The toy bank of claim 1, wherein the first audio signal is a first recorded message and wherein the second audio signal is a second recorded message.

8. The toy bank of claim 1, further comprising:

a conveying means to support the movement of launched coins from the target area to the collection area.

* * * * *

UNITED STATES PATENT AND TRADEMARK OFFICE

CERTIFICATE OF CORRECTION

PATENT NO. : 5,697,828
DATED : December 16, 1997
INVENTOR(S) : Smathers et al.

It is certified that error appears in the above-identified patent and that said Letters Patent is hereby corrected as shown below:

In column 1, at line 5, please delete "my articles" and insert --toy articles--.

In column 2, at line 3, please delete "fast area" and insert --first area--.

In column 2, at line 9, please delete "hunched toward" and insert --launched toward--.

In column 3, at line 1, please delete "coin bunching means" and insert --coin launching means--.

In column 4, at line 23, please delete "way also includes" and insert --tray also includes--.

In column 4, at line 40, please delete "to the way 430. The way 430" and insert --to the tray 430. The tray 430--.

In column 5, at line 17, please delete "ItS GOOD" and insert --IT'S GOOD--.

In column 6, claim 2, at line 43, please delete "housing couples to said base encapsulating said target" and insert --housing coupled to said base and encapsulating said target--

Signed and Sealed this

Twentieth Day of July, 1999

*Attest:*

Q. TODD DICKINSON

*Attesting Officer*

*Acting Commissioner of Patents and Trademarks*